US005349886A

United States Patent [19]

Jin

[11] Patent Number: 5,349,886

[45] Date of Patent: Sep. 27, 1994

[54] HAND SCREW DRIVER

[76] Inventor: Soo W. Jin, 466 Seogodori, Kummamyun, Iksankun, Chulabukdo, Rep. of Korea

[21] Appl. No.: 94,903

[22] Filed: Jul. 22, 1993

[30] Foreign Application Priority Data

Aug. 25, 1992 [KR] Rep. of Korea ..... 92-16023
Apr. 2, 1993 [KR] Rep. of Korea ..... 93-5256

[51] Int. Cl.[5] ..... B25G 3/02

[52] U.S. Cl. ..... 81/37; 81/73; 81/177.1; 81/436

[58] Field of Search ..... 81/73, 28, 35, 37, 177.1, 81/436

[56] References Cited

U.S. PATENT DOCUMENTS

| | | | |
|---|---|---|---|
| 470,687 | 3/1892 | Koelzer | 81/436 |
| 1,713,434 | 5/1929 | Herrold | 81/28 |
| 2,761,341 | 9/1956 | Stahl | 81/73 |
| 2,775,276 | 12/1956 | Rossner | 81/177.1 |
| 2,810,455 | 10/1957 | Johnson | 81/28 |
| 4,974,477 | 12/1990 | Anderson | 81/37 X |

FOREIGN PATENT DOCUMENTS

| | | | |
|---|---|---|---|
| 678566 | 1/1964 | Canada | 81/58.3 |
| 2149188 | 4/1973 | Fed. Rep. of Germany | 81/37 |

*Primary Examiner*—D. S. Meislin
*Attorney, Agent, or Firm*—Stevens, Davis, Miller & Mosher

[57] ABSTRACT

A hand screw driver preventing a user's wrist from being twisted during screw driving operation. The screw driver comprises an offset shank having a tip at its lower end and being bent twice such that it has a Z-shape, and a handle having a shank receiving hole for rotatably receiving an upper section of the offset shank. The offset shank is shifted between a fixed position wherein it is fixed to the handle and a rotatable position wherein it is relatively rotated with respect to the handle. A biasing member is provided in the shank receiving hole of the handle to bias the handle with respect to the shank to shift the shank between the fixed position and the rotatable position as required. In one embodiment, the offset shank is provided at its upper section with an annular groove for receiving an annular leaf spring, and the handle is cut in at least two parts and provided in the shank receiving hole with an annular groove for receiving the annular leaf spring to hinge the offset shank to the handle, thus holding the offset shank to prevent its relative rotation with respect to the handle when the handle is inclined.

4 Claims, 4 Drawing Sheets

HAND SCREW DRIVER

BACKGROUND OF THE INVENTION

1. Field of the Invention

The present invention relates to a hand screw driver, and more particularly to a hand screw driver employing an offset shank rotating with respect to a handle, thereby carrying out a desired screw driving function without the necessity of providing an intermission for releasing the twisted state of the user's wrist during the screw driving operation.

2. Description of the Prior Art

Screw drivers are generally classified into plus driver and minus-type drivers in accordance with the shape of a screwdriver's recessed tip. Another type of driver having a recessed tip, for example, a tip having a square cross section or a tip having a hexagonal cross section, has been proposed and widely used. As well known to those skilled in the art, the plus driver and the minus driver are used for tightening or releasing plus-type bolts and minus-type bolts, respectively. A fixed type screw driver, which is most wide used, is restricted in its use since its shank having the tip is fixed to the handle.

In addition, when a high screw driving force is required, a motor screw driver or a torque control driver is preferably used. On the other hand, there has been proposed an offset screw driver which is provided with a crank-shaped shank suitable for increasing the torque imparted to the screw.

In operation of the fixed type screw driver, the tip of the shank is placed on the recessed head of a screw and the handle fixed to the shank is rotated to impart the rotational force or the driving force to the screw. In order to rotate the handle of the fixed type screw driver, the user's wrist is inevitably twisted, so that it should be required to often intermit the screw driving work in order to release the twisted state of the wrist and regrip the handle. Thus, the known fixed type screw driver has a problem in that the screw driving work using it is regarded as a burdensome work.

When using the known offset screw driver, the intermission of the screw driving work caused by the twisted state of the user's wrist is overcome. However, the known offset screw driver has a problem in that it is relatively complicated in its construction and involves capital investment. Furthermore, the handles of the known offset screw driver are rotatably mounted on the offset shank, respectively, so that it is difficult to place the tip of the shank on the recessed head of a screw to be tightened or released.

SUMMARY OF THE INVENTION

It is, therefore, an object of the present invention to provide a hand screw driver in which the aforementioned problems can be overcome and which comprises a handle which rotatably receives the upper section of an offset shank bent twice into a Z shape, thereby continuously rotating and driving a screw without requiring intermission of the screw driving work and easily achieving the desired screw driving work.

It is another object of the present invention to provide a hand screw driver of which a handle is cut in at least two parts, thereby making the shank be selectively fixed to the handle, as required, by inclining the handle parts and easily placing the tip of the shank on a recessed screw head.

BRIEF DESCRIPTION OF THE DRAWINGS

The above and other objects, features and other advantages of the present invention will be more clearly understood from the following detailed description taken in conjunction with the accompanying drawings, in which:

FIGS. 1 and 2 are sectional views of a hand screw driver in accordance with a primary embodiment of the present invention, in which:

FIG. 1 shows an upper section of an offset shank received in a circular receiver of a handle; and FIG. 2 shows the upper section of the offset shank received in an angular receiver of the handle;

DESCRIPTION OF THE PREFERRED EMBODIMENTS

Figure 1:
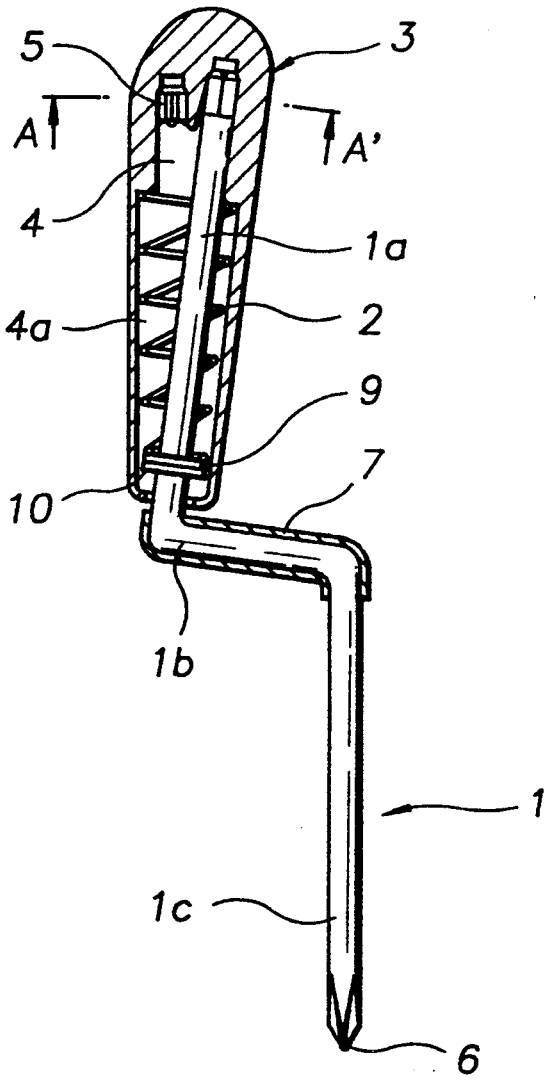
Figure 2:
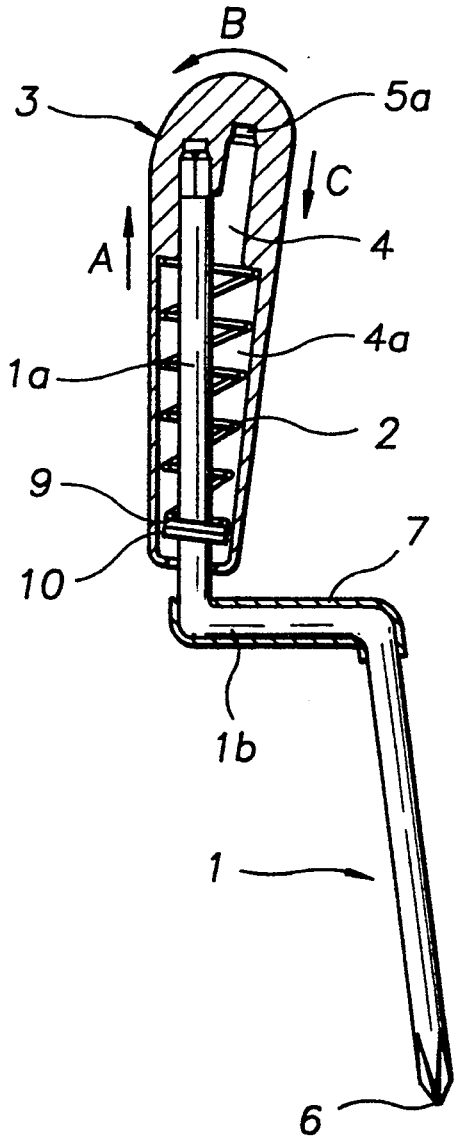

With reference to FIGS. 1 and 2 showing in sectional views a hand screw driver in accordance with a primary embodiment of the present invention, the hand screw driver includes an offset shank 1 which is bent twice such that has a crank shape, that is, a Z-shape. The screw driver further includes a handle 3 which has a stepped receiving hole comprising a small diameter upper hole 4 and a large diameter lower hole 4*a*. The upper hole 4 is provided at its bottom with a shank engagement end having two types of shank receivers 5 and 5*a*. The offset shank 1 is elastically received in the receiving hole of the handle 3 while being biased by a biasing member. In this primary embodiment, the biasing member preferably comprises a compression coil spring 2 supported around the upper section of the shank 1 inside the lower hole 4*a*.

In the primary embodiment, the offset shank 1 has a plus tip 6 at its free end, so that it is used for tightening or releasing a cross recessed screw or a plus screw (not shown). However, it should be understood that there exist a variety of tip configurations, such as a minus tip, a square Lip and hexagonal tip, which yield the same result as that will be described for the primary embodiment without affecting the functioning of this invention. Moreover, the offset shank 1 may have a variety of cross sections, for example, a square cross section, a circular cross section and a triangular cross section. Due to the twice bent configuration of the offset shank 1, the offset shank 1 comprises three shank sections, that is, an upper shank section 1*a*, a middle shank section 1*b* and a lower shank section 1c. Here, the middle shank section 1b of the offset shank 1 is inclined at an obtuse angle with respect to the lower shank section 1c such that it is nearly perpendicular to the upper shank section 1a. The middle shank section 1b is also covered with a coating material 7, such as a synthetic resin or a cotton. This coating material 7 prevents the user such as from receiving electric shock when the user places the tip 6 of the shank 1 on the screw while gripping the handle 3 as well as the offset shank 1 by a hand.

Figure 4:
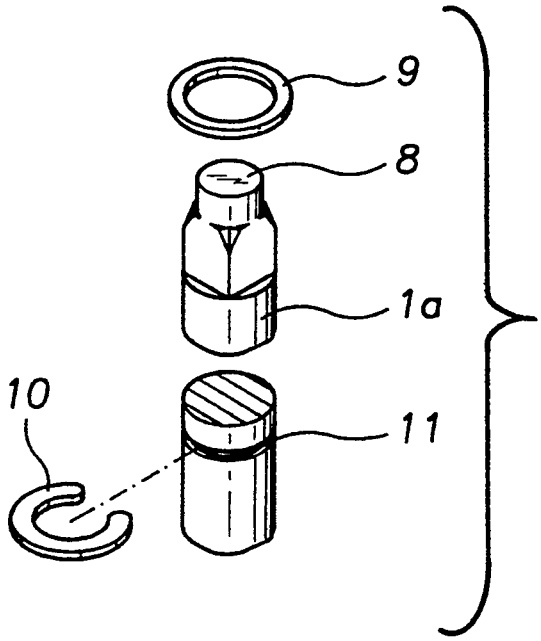
FIG. 4 is an exploded perspective view of the upper section of the offset shank of the screw driver of FIG. 1.

Referring to FIG. 4, the upper shank section la has a circular protrusion end 8 extending from an angular part adapted for selectively fixing the offset shank 1 to the handle 3. In this embodiment, the angular part of the section 1a has a square cross section, however, it may have a variety of sectional configurations, such as a triangular section, a pentagonal section and a hexagonal section. In order to. support the lower end of the compression coil spring 2, the upper shank section 1a has an annular groove 11 for receiving an annular leaf spring 10 supporting a spring retaining ring 9.

Figure 3:
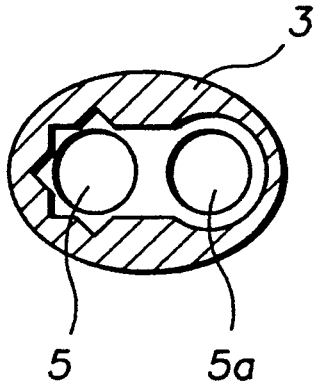
FIG. 3 is a cross sectional view of the handle taken along the section line A-A' of FIG. 1.

In the primary embodiment of the present invention, the offset shank 1 is relatively rotated with respect to the handle 3 or fixed to the handle 3. In order to achieve the above object, the shank engagement end of the handle 3 has two types of shank receivers 5 and 5a neighboring with each other as best seen in a sectional view of FIG. 3. That is, the shank engagement end has an angular receiver 5 and a circular receiver 5a. The angular receiver 5 is angularly recessed in order to correspond to the outer appearance of the angular part of the upper shank section 1a and restricts the relative rotation of the shank 1 to the handle 3. However, the circular receiver 5a is rounded such that the angular part of the upper shank section la is freely rotated with respect to the handle 3.

Figure 5:
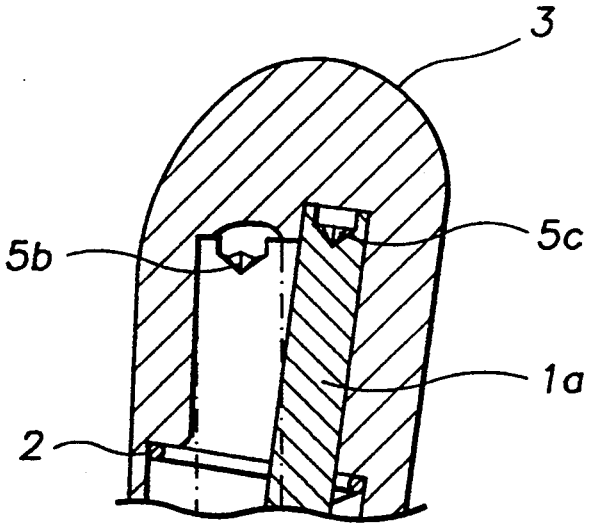
FIG. 5 is a partially transverse sectional view of a handle of a hand screw driver in accordance with a second embodiment of the present invention.
Figure 6:
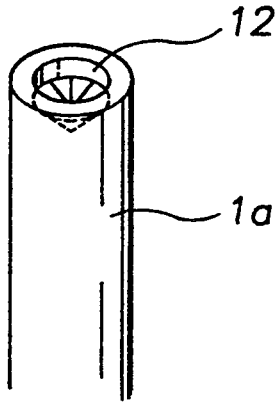
FIG. 6 is an enlarged perspective view of an upper section of a shank of the screw driver of FIG. 5.

Referring to FIGS. 5 and 6, there are shown a handle and an upper shank section of an offset screw driver in accordance with a second embodiment of the present invention, respectively. In this second embodiment, the shank upper section has a recess 12 instead of the protrusion 8 at its top as shown in FIG. 6. The recess 12 comprises a cylindrical upper section and a toothed conical lower section. In order to correspond to the recess 12, the shank engagement end of the handle 3 is altered in such a manner that a toothed conical protrusion 5b corresponding to the toothed conical section of the recess 12 is formed so as to restrict the relative rotation of the shank 1 with respect to the handle 3 and a conical protrusion 5c neighbors the toothed conical protrusion 5b to allow the relative rotation of the shank In the primary and second embodiments, the compression 1. coil spring 2 is supported inside the lower receiving hole 4a between the step and the retaining ring 9 to bias the shank 1.

In operation, the upper shank section 1a of the offset shank 1 is optionally shifted between the two positions, that is, between the first position, wherein it is received in the angular receiver 5 and is restricted from relative rotation with respect to the receiver 5 as shown in FIG. 2, and the second position where in it is received in the circular receiver 5a and is freely rotated with respect to the receiver 5a as shown in FIG. 1. In order to shift the upper shank section 1a from the angular receiver 5 to the circular receiver 5a, an outside force imparted to the handle 3 at the state of FIG. 2 is released, thus causing the handle 3 to move upwards with respect to the upper shank section 1a by the restoring force of the compression coil spring 2 as shown at the arrow A of FIG. 2. The upper section of the shank 1 thus elastically escapes from the angular receiver 5. At this state, the handle 3 is turned as shown at the arrow B of FIG. 2 and in turn is pushed downwards as shown at the arrow C of FIG. 2, so that the upper section of the shank 1 is received by the circular receiver 5a.

In the same manner, the upper shank 1a can be shifted from the second position wherein it received by the circular receiver 5a to the first position wherein it is received by the angular receiver 5.

Since the upper shank 1a is simply shifted between the two positions as required, the offset screw driver according to the primary and second embodiments of this invention is used as a conventional fixed type screw driver by inserting the upper shank section la in the angular receiver 5. However, when the upper shank section la is received by the circular receiver 5a, the handle 3 is rotated relative to the shank 1, so that the twisted state of the wrist is prevented and the screw driving work is achieved without intermission for releasing the twisted state of the user's wrist.

In accordance with the primary and second embodiments of the present invention, the screw driving force of the screw driver is easily controlled by shifting the upper shank 1a between the two positions. That is, when a relative lower driving force is required, the upper shank la is received the circular receiver 5a, so that the handle 3 is relatively rotated with respect to the upper shank la. However, when a relative higher driving force is required, the upper shank 1a is received by the angular receiver 5, so that it is fixed to the handle 3. In addition, the screw driver of this invention achieves a desired screw driving operation even when there is an obstacle, preventing the revolution of the handle 3 around the shank 1, about the screw to be tightened or released.

Figure 8:
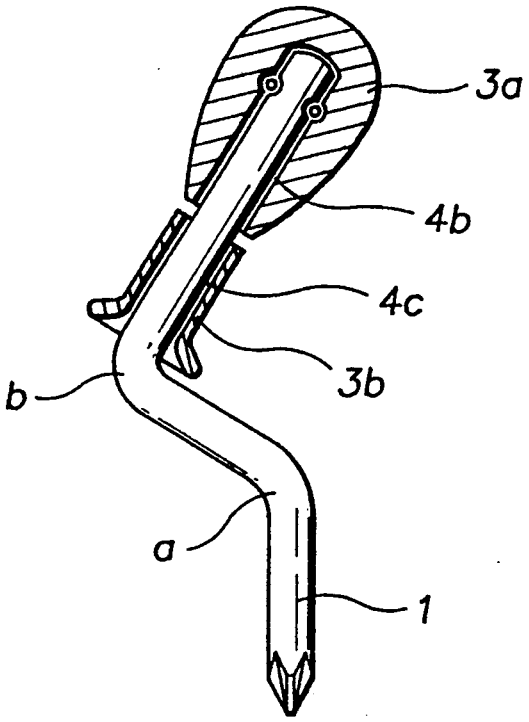
FIG. 8 is a sectional view of the screw driver of FIG. 7.
Figure 9:
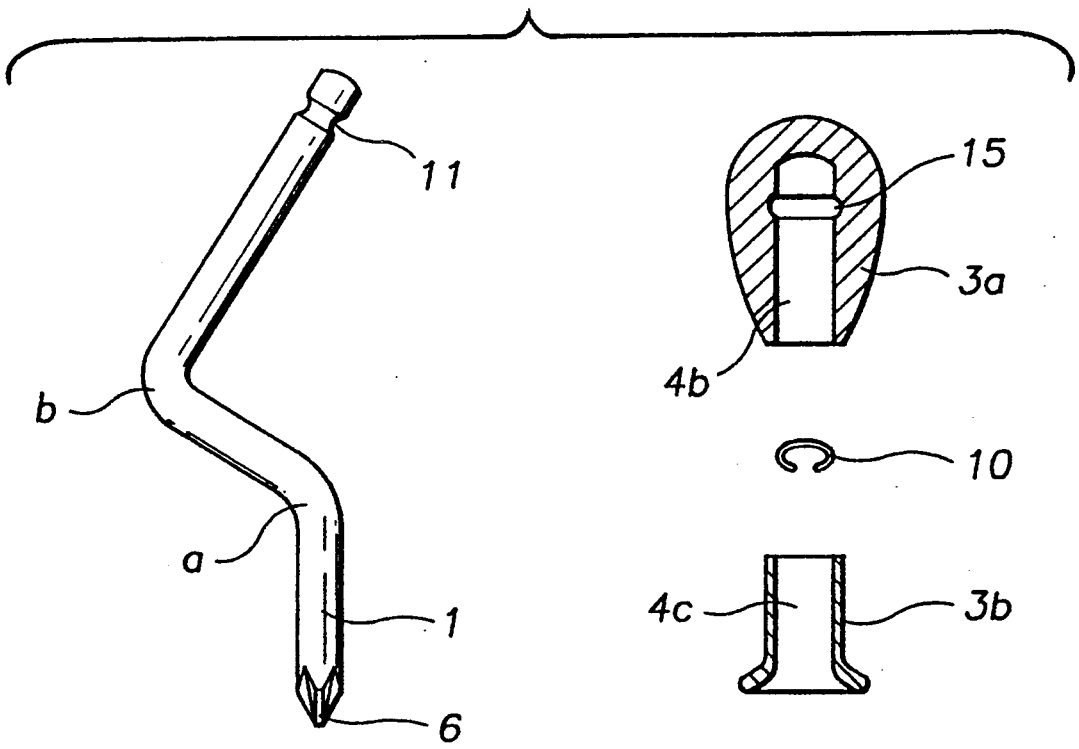
FIG. 9 is an exploded sectional view of the screw driver of FIG. 7.
Figure 10:
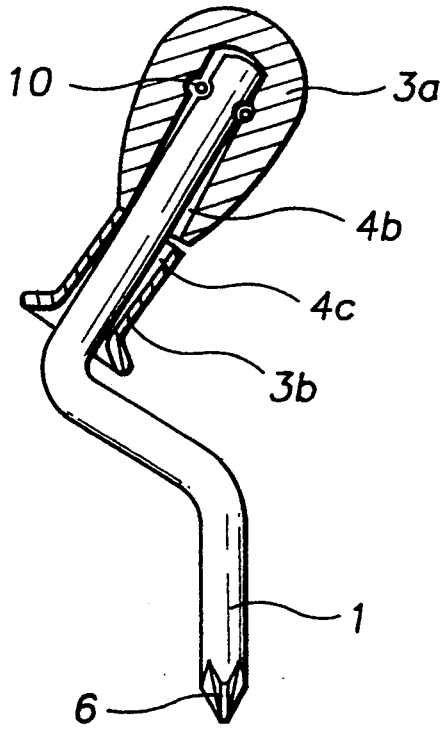
FIG. 10 is a sectional view of the screw driver of FIG. 7 for showing an inclined position of the handle parts for fixing the offset shank.

Turning to FIGS. 8 to 10, there is shown a hand screw driver in accordance with a third embodiment of the present invention, In the third embodiment, the screw driver includes an offset shank 1 which is bent twice at the bending points a and b. The offset shank 1 is also provided at its upper section with an annular groove 11 for receiving the annular leaf spring 10.

The offset shank 1 is rotatably received in a handle 3 which is cut in at least two parts. In the third embodiment, the handle 3 is preferably cut in two parts, that is, an upper part 3a and a lower part 3b. In order to rotatably receive the upper shank of the offset shank 1, the upper part 3a and the lower part 3b of the handle 3 are provided with individual receiving holes 4b and 4c. Each of the receiving holes 4b and 4c has an inner diameter providing a predetermined play between the shank 1 and the inner surface of the handle 3, thereby permitting the upper shank to be rotated therein. The receiving hole 4c of the lower part 3b is an axial through hole, while the receiving hole 4b of the upper part 3a is provided, at a position corresponding to the annular groove 11 of the offset shank 1, with an annular groove 15 for receiving the annular leaf spring 10.

As described above, each of the receiving holes 4b and 4c of the handle 3 has such size that the predetermined play, permitting the shank 1 to be rotated the handle 3, is provided between the shank 1 and the inner surface of the handle 3. In addition, the upper section of the offset shank 1 is elastically hinged to the upper part 3a of the handle 3 by the leaf spring 10, so that it is prevented from separation from the upper part 3a of the handle 3. The offset shank 1 is thus rotated with respect to the handle 3.

Figure 7:
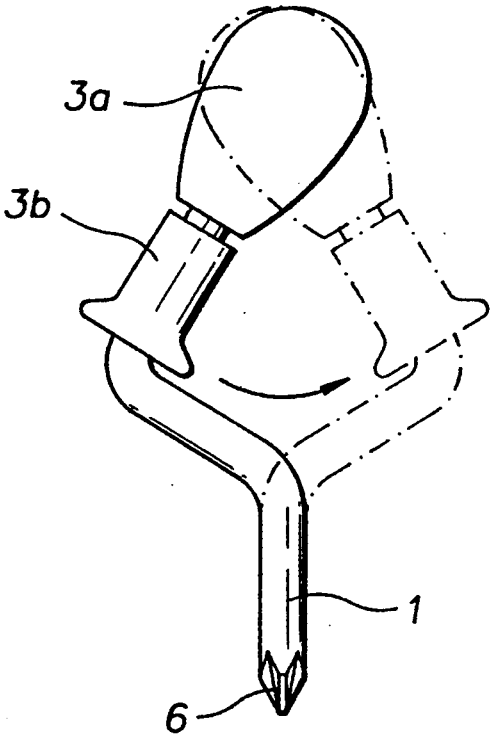
FIG. 7 is a side view showing an operation of a hand screw driver in accordance with a third embodiment of the present invention.

In operation, as shown in FIG. 7, the handle 3 is rotated under the condition that the cross tip 6 of the offset shank 1 is placed on the recessed head of a screw (not shown) to be tightened or released, thereby achieving the desired screw driving operation.

Here, since the upper section of the offset shank 1 is hinged to and freely rotated in the upper part 3*a* of the handle 3, it may be somewhat difficult to place the tip 6 of the shank 1 on the recessed head of the screw. In addition, to fix the offset shank 1 to a desired position while gripping the handle 3 by a hand is difficult. Moreover, since the offset shank 1 is made of a conductor, the user should often carries out the screw driving operation without gripping the offset shank 1, such as when the screw driver is used for tightening or releasing a screw about a place where danger of an electric shock is involved, such as about an electric equipment. In this case, it is very difficult to exactly place the tip 6 of the shank 1 on the recessed head of the screw.

However, in accordance with the third embodiment of the present invention, the handle 3 is cut in two parts, that is, the upper part 3*a* and the lower part 3*b*. Thanks to such a construction of the handle 3, the user can fix the offset shank 1 by tilting or inclining the handle 3 as shown in FIG. 10 so as to prevent the relative rotation of the offset shank 1 with respect to the handle 3. That is, the handle 3 may be adjusted so that the walls of the recesses 4B, 4C come into frictional contact with the upper portion of shaft 1. The frictional force prevents rotation of shaft 1 with respect to handle 3. Thus, the tip 6 of the offset shank 1 is easily placed on the recessed screw head exactly.

When the exact placing of the tip 6 on the recessed screw head is achieved, the handle 3 is rotated so as to tighten or release the screw.

As described above, the present invention provides an offset screw driver which comprises a handle which rotatably receives the upper section of an offset shank bent twice into a Z shape, thereby continuously rotating and driving a screw without intermission of the screw driving work and easily achieving the desired screw driving work, In accordance an embodiment of this invention, a handle of the hand screw driver is cut in at least two parts, thereby making the shank be selectively fixed to the handle as required, by inclining the handle parts and easily placing the tip of the shank on a recessed screw head.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hand screw driver comprising:

an offset shank having a tip at its lower end and an angular recess at its top end, said shank being bent twice to have a Z-shape;

a handle having a shank receiving hole for rotatably receiving an upper section of said offset shank, said shank receiving hole being a stepped hole comprising a small diameter upper hole and a large diameter lower hole;

shank engaging means, provided at said small diameter upper hole of said shank receiving hole, for selectively engaging said top end of said offset shaft in one of (i) a fixed position wherein said shank is fixed with respect to said handle and (ii) a rotatable position wherein said shank is relatively rotatable with respect to said handle, said shank engaging means comprising (i) an angular protrusion, corresponding to said angular recess of said offset shank, for fixing said offset shank to said handle when said angular protrusion engages with said angular recess, and (ii) a cylindrical protrusion, neighboring with said angular protrusion, for allowing said shank to be relatively rotated with respect to said handle when said cylindrical protrusion engages with said angular recess; and biasing means, provided about said upper section of said shank in said handle, for biasing said handle with respect to said shank, said biasing means operable to aid in shifting said shank between said fixed position and said rotatable position, whereby said hand screw driver prevents a user's wrist from being twisted during a screw driving operation.

2. A hand screw driver according to claim 1, wherein said offset shank is covered at its middle section with a covering material.

3. A hand screw driver according to claim 2, wherein said covering material comprises a resin.

4. A hand screw driver according to claim 2, wherein said covering material comprises cotton.

* * * * *